US006738591B2

(12) United States Patent
Hattori et al.

(10) Patent No.: US 6,738,591 B2
(45) Date of Patent: May 18, 2004

(54) DEVELOPING DEVICE WITH EXCHANGEABLE TONER BOX

(75) Inventors: Tomoaki Hattori, Nagoya (JP); Mitsuru Horinoe, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/107,338

(22) Filed: Mar. 28, 2002

(65) Prior Publication Data

US 2002/0141787 A1 Oct. 3, 2002

(30) Foreign Application Priority Data

Mar. 30, 2001 (JP) ..... 2001-101778

(51) Int. Cl.[7] ..... G03G 15/08
(52) U.S. Cl. ..... 399/119; 399/257
(58) Field of Search ..... 399/119, 120, 399/257, 103, 106

(56) References Cited

U.S. PATENT DOCUMENTS 4,913,087 A * 4/1990 Saita et al. ..... 399/257 X
4,974,023 A * 11/1990 Aimoto et al. ..... 399/119

* cited by examiner

*Primary Examiner*—William J. Royer
(74) *Attorney, Agent, or Firm*—Oliff & Berridge, PLC

(57) ABSTRACT

An image forming device includes a housing, a photosensitive drum, a developing unit, and a developing-agent moving configuration. The developing unit is freely detachably attached to the housing and includes an exchangeable toner box and a developing chamber, which are freely detachably attached to each other. The toner box has a through hole for supplying toner to the developing chamber. The developing portion includes a developing roller that rotates to transport toner from the toner box to a latent image on the photosensitive drum. The developing-agent moving configuration functions to move residual toner from the developing chamber into the present toner box before the toner box is exchanged for a new toner box.

17 Claims, 7 Drawing Sheets

DEVELOPING DEVICE WITH EXCHANGEABLE TONER BOX

BACKGROUND OF THE INVENTION

1. Field of Invention

The present invention relates to a developing device having an exchangeable toner box.

2. Description of Related Art

A conventional developing device used in a laser printer includes a toner hopper and a developing chamber. The toner hopper holds a non-magnetic, single-component toner or other type of toner. The developing chamber is provided with a developing roller, a supply roller, and a layer-thickness regulating blade.

The toner hopper holds only a finite amount of toner that needs to be replenished as toner is used up during developing operations. Toner boxes filled with new toner can be provided separately for replenishing the used up toner in the toner hopper. In one known configuration, the toner box is formed with a hole that is covered with a film. The toner box is mounted on top of the toner hopper so that the hole in the toner box is aligned with an opening formed in the upper portion of the toner hopper. After the toner box is mounted, the film is removed so that toner falls from the toner box into the toner hopper. However, this configuration has a problem in that the toner can leak out from the opening or the operator's hands can become stained with toner because the opening in the toner hopper is exposed.

To overcome this problem, some developing devices are provided as an independent drum cartridge that can be attached to and detached from an image forming device. When all the toner in one drum cartridge is used up, then the entire drum cartridge is replaced with a new one. With this configuration, new toner can be provided for developing operations without fear of toner leaks or staining the operator's hands. However, generally the developing device runs out of toner before the developing roller has reached the end of its useful life, that is, while the developing roller is still in a usable condition. When toner is replaced by replacing the entire drum cartridge, the developing roller is also replaced so the developing roller is wasted.

To overcome this problem, one type of developing device is made with just the toner hopper portion in the form of a cartridge, rather than the entire developing device. With this configuration, only the toner cartridge is replaced when the developing device runs out of toner. As a result, the developing roller in the developing chamber can be effectively used without fear of toner leaks or toner stains occurring during exchange of the toner cartridge.

However, this configuration also has room for improvement. Not all toner that is supplied from the toner hopper to the developing chamber is used during the image developing process. Some toner collects and accumulates in the developing chamber. This toner has degraded quality. For example, non-magnetic, single-component toner is easily degraded by stress applied during the developing process. The degraded toner can remain in the developing chamber even though the toner cartridge is replaced and can mix in with new toner from the new toner cartridge because of shocks that occur when the new toner cartridge is mounted onto the developing device or because of vibration applied to the developing device after the new toner cartridge is mounted. Problems can occur when the degraded toner mixes with new toner. For example, because toner is charged by a very sensitive mechanism, if a great deal of degraded toner remains in the developing chamber, then oppositely charged toner, that is, toner particles with a charge opposite of the normal particle charge, can be generated that results in fog, degradation of the image quality, and variation in image quality.

SUMMARY OF THE INVENTION

It is an objective of the present invention to overcome the above-described problems and provide a developing device, and an image forming device that uses the developing device, that prevent problems such as occurrence of fog, degradation of the image quality, and variation in image quality from occurring even after a toner cartridge is replaced.

To achieve the above-described objectives, a developing device according to the present invention includes an exchangeable developing-agent holding portion, a developing portion, and a developing-agent moving means. The developing-agent holding portion and the developing portion are freely detachably attached to each other. The developing-agent holding portion holds developing agent and has a through hole for supplying the developing agent. The developing portion is in fluid communication with the through hole of the developing-agent holding portion. The developing portion includes a developing-agent bearing body that has a surface bearing developing agent supplied from the developing-agent holding portion through the through hole. The developing-agent moving means functions to move residual developing agent from the developing portion into the developing-agent holding portion before the developing-agent holding portion is exchanged for a new developing-agent holding portion.

An image forming device according to the present invention includes a housing, a latent image bearing unit, a developing unit, and a developing-agent moving means. The developing unit is freely detachably attached to the housing and includes an exchangeable developing-agent holding portion and a developing portion. The developing-agent holding portion holds developing agent and has a through hole for supplying the developing agent. The developing portion is in fluid communication with the through hole of the developing-agent holding portion. The developing portion includes a developing-agent bearing body that has a surface that bears developing-agent supplied through the through hole of the developing-agent holding portion. The developing-agent bearing body transports developing agent borne on the surface to a latent image borne by a latent image bearing unit. The developing-agent holding portion is freely detachably attached to the developing portion. The developing-agent moving means functions to move residual developing agent from the developing portion into the developing-agent holding portion before the developing-agent holding portion is exchanged for a new developing-agent holding portion.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF PREFERRED EMBODIMENTS

Figure 1:
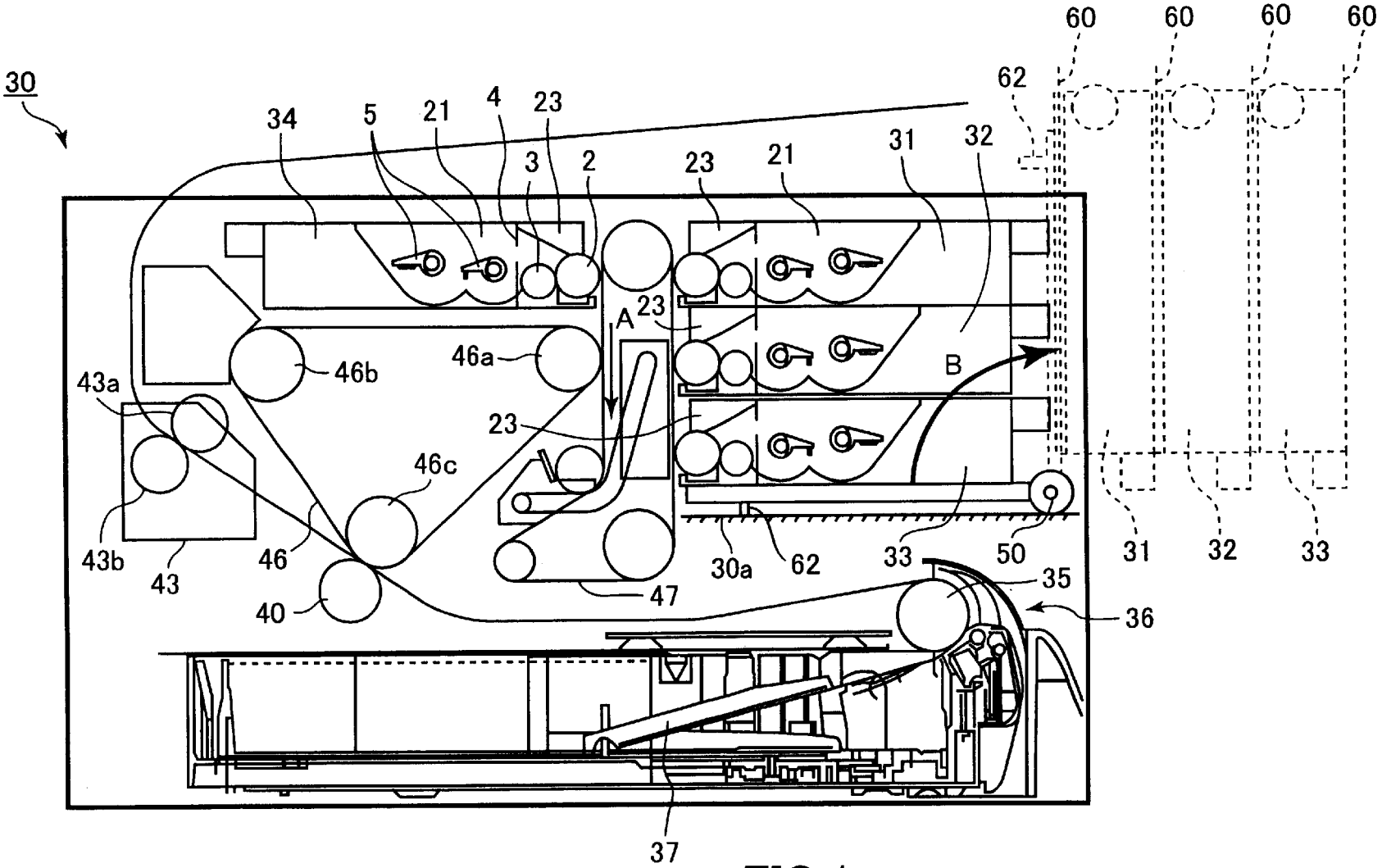
FIG. 1 is a schematic cross-sectional view showing a color printer according to an embodiment of the present invention.

Next, a color printer 30 according to a first embodiment of the present invention will be described while referring to the FIGS. 1 to 5. As shown in FIG. 1, the color printer 30 includes developing units 31 to 34, a sheet-supply unit 36, a transfer roller 40, an intermediate transfer belt 46, a photosensitive body belt 47, and a fixing unit 43.

The sheet-supply unit 36 includes a holding tray 37 that holds paper sheets and a pick-up roller 35 that feeds out the sheets one at a time. The sheet-supply unit 36 supplies sheets at a predetermined timing in accordance with image forming operations performed by the photosensitive body belt 47, a scanner unit (not shown), the developing units 31 to 34, and the intermediate transfer belt 46.

The photosensitive body belt 47 is suspended on rollers and driven to follow the direction indicated by an arrow A in FIG. 1. The photosensitive body belt 47 includes a base sheet and a photosensitive layer. The base sheet is a PET film, for example, formed on its surface with an aluminum deposition layer. The photosensitive layer is formed on the base film in a single layer configuration and has a positively charging nature. Although not shown in the drawings, a charge unit and a scanner unit are provided for forming a latent static-electric image on the surface of the photosensitive layer. The charge unit charges the photosensitive layer to a uniform charge and the scanner unit emits laser light to expose the photosensitive layer in order to form the latent static-electric image.

The developing units 31 to 34 are disposed in confrontation with the photosensitive body belt 47 at positions following the direction that the photosensitive body belt 47 moves indicated by the arrow A in FIG. 1. The developing units 31 to 34 hold magenta, cyan, yellow, and black toner, respectively for developing magenta, cyan, yellow, and black portions, respectively of the latent static-electric image formed on the photosensitive body belt 47. The toner held in the developing units 31 to 34 is a non-magnetic single-component toner made using a polymerization process. The developing units 31 to 33 for holding the magenta, cyan, and yellow color toners are provided in an integral group separate from the developing unit 34 for black toner. Hereinafter, the developing units 31 to 33 will be referred to as the MCY developing units 31 to 33 to clarify that they hold magenta, cyan, and yellow toner, respectively, and to distinguish them from the developing unit 34 for black toner. The developing units 31 to 34 will be described in more detail later.

The intermediate transfer belt 46 is formed from a belt-shaped sheet of polycarbonate, polyimide, or other material imparted with conductive properties. The intermediate transfer belt 46 is suspended on three rollers 46*a,* 46*b,* and 46*c*. The roller 46*a,* which is positioned where the intermediate transfer belt 46 contacts the photosensitive body belt 47, is applied with a predetermined voltage that draws the full-color toner image from the photosensitive body belt 47 onto the intermediate transfer belt 46.

The transfer roller 40 is disposed in confrontation with the roller 46*c* with the intermediate transfer belt 46 sandwiched therebetween. Further, sheets supplied by the sheet-supply unit 36 are transported in between the transfer roller 40 and the intermediate transfer belt 46. The four-color toner image that was transferred onto and borne by the intermediate transfer belt 46 is transferred onto sheets that are transported in between the transfer roller 40 and the intermediate transfer belt 46.

The fixing unit 43 includes a thermal roller 43*a* and a pressing roller 43*b*. Sheets that bear a four-color toner image are pressed and heated by the thermal roller 43*a* and the pressing roller 43*b* while being transported between the thermal roller 43*a* and the pressing roller 43*b* so that the toner image is fixed to the sheet.

The color printer 30 forms images in the following manner. First, the charge unit (not shown) charges the photosensitive layer of the photosensitive body belt 47 to a uniform charge. Next, the scanner unit (not shown) emits laser light to expose the photosensitive layer at areas that correspond to the magenta-color portion of the full color image, thus forming a latent static-electric image on the photosensitive layer. Then, magenta-color toner from the developing unit 31 impinges on the latent static-electric image formed on the photosensitive layer of the photosensitive body belt 47, thereby developing the latent static-electric image into a magenta-colored image. The magenta-colored image is then transferred onto the surface of the intermediate transfer belt 46.

The toner that remains on the photosensitive body belt 47 after transfer is removed by a cleaning unit (not shown) and the charge unit again charges the photosensitive layer of the photosensitive body belt 47 to a uniform charge. Next, the scanner unit emits laser light to expose the photosensitive layer at areas that correspond to the cyan color image. The same processes that were performed for developing magenta color are performed to form a cyan color toner image on the photosensitive body belt 47.

The cyan color toner image is transferred and superimposed onto the magenta color toner image borne on the intermediate transfer belt 46, and is then itself borne on the intermediate transfer belt 46.

The same processes are performed for yellow and black colors to form a four-color toner image on the intermediate transfer belt 46. Then, at the position where the transfer roller 40 and the intermediate transfer belt 46 press against each other, the four-color toner image is transferred to the sheet supplied from the sheet-supply unit 36. Then the fixing unit 43 fixes the toner image onto the sheet and discharges the sheet onto a sheet-discharge tray. In this way, a four-color image is formed.

Figure 2:
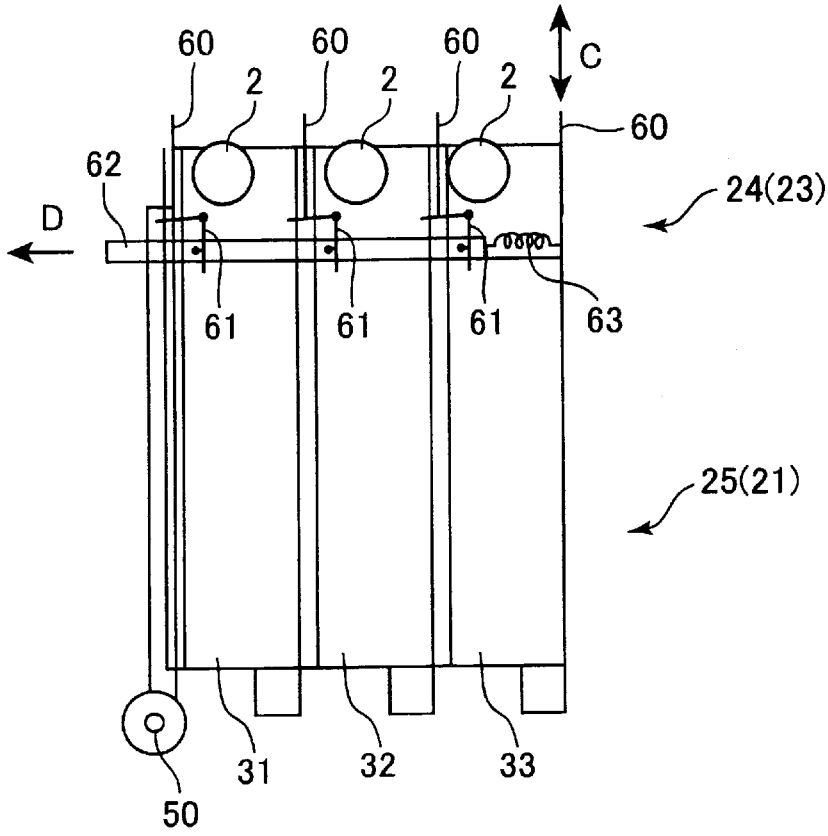
FIG. 2 is a schematic cross-sectional view showing integral developing units of the color printer of FIG. 1.

Next, the configuration of the developing units 31 to 34 used in the color printer 30 will be described in more detail. Each of the developing units 31 to 34 includes a toner hopper 21 and a developing chamber 23 that are freely detachably attached to each other. As shown in FIG. 2, the toner hoppers 21 of the three MCY developing units 31 to 33 are formed integrally together to configure a toner box 25. Also, the developing chambers 23 of the three MCY developing units 31 to 33 are formed integrally together to configure a developing portion 24. The developing portion 24 is freely detachable from the toner box 25. The developing unit 34 is provided independently from the MCY developing units 31 to 33 at a position separated from the MCY developing units 31 to 33.

Each toner hopper 21 is formed with a through hole 4 for supplying the developing agent to the corresponding developing chamber 23 and includes agitators 5 for maintaining the toner in a fluffed up condition and for pushing the toner through the through hole 4 to the corresponding developing chamber 23.

The developing chamber 23 of each of the developing units 31 to 34 includes a developing roller 2 and a supply roller 3. The supply roller 3 is, for example, a conductive sponge roller and is disposed so as to press against the developing roller 2 by resilient force of the sponge. It should be noted that other suitable materials, such as conductive silicon rubber of urethane rubber, can be used to make the supply roller 3 instead. The supply roller 3 bears on its surface toner supplied from the corresponding toner hopper 21 through the through hole 4 and rotates to supply the toner to the developing roller 2.

Each developing roller 2 has a cylinder-shaped base and a coat layer. The base is formed from a conductive silicon rubber or conductive urethane rubber. The coat layer is formed on the surface of the base and can be formed from a resin or rubber material that contains fluoride. It is desirable to make the coat layer from urethane rubber to increase the durability of the developing roller 2. When the coat layer is made from urethane rubber, image development operations can be properly performed over a long period of time even if the same developing portion 24 is used while repeatedly exchanging the toner box 25.

During normal developing processes, the developing rollers 2 rotate in the direction indicated by arrows in FIG. 1 so that the coat layer of the developing roller 2 bears toner that was supplied from the corresponding toner hopper 21 through the through hole 4. The developing roller 2 is applied with a predetermined voltage so that a predetermined bias develops between the developing roller 2 and the photosensitive body belt 47. As a result, the toner borne on the coat layer is transferred to portions of the photosensitive body belt 47 formed with a latent static-electric image as described above.

Although not shown in drawings, the integral MCY developing units 31 to 33 each include U-shaped bearings that are mounted on a support shaft 50. With this configuration, the integral MCY developing units 31 to 33 are pivotable in the direction indicated by arrow B into the upright posture indicated by broken line in FIG. 1 and as shown in FIG. 2.

As shown in FIG. 2, the integral MCY developing units 31 to 33 are provided with a lever 62 and a spring 63. The spring 63 urges the lever 62 to protrude in the direction D of FIG. 2, that is, downward with respect to the orientation of the MCY developing units 31 to 33 when disposed in the color printer 30. Each of the MCY developing units 31 to 33 are provided with a separate protective member 60 that is movable in the directions indicated by arrows C in FIG. 2 and a link mechanism 61 that connects the corresponding protective member 60 to the lever 62. When the MCY developing units 31 to 33 are positioned in confrontation with the photosensitive body belt 47 as shown in FIG. 1, the lever 62 abuts against an internal portion 30*a* of the color printer 30 so the lever 62 is pushed in the opposite direction of arrow D of FIG. 2 against the urging force of the spring 63. As a result, the link mechanisms 61 retract the protective members 60 into the MCY developing units 31 to 33.

Here, operations for exchanging the toner box 25 for a new one will be described. First, the user pivots the MCY developing units 31 to 33 around the support shaft 50 in the direction indicated by arrow B into the upright posture. When in this upright posture, the developing portion 24 is located above the toner box 25 so that any degraded toner that remains in the developing portion 24 falls through the through holes 4 into the toner box 25 by the pull of gravity.

At this time, a control unit (not shown) of the color printer 30 controls to rotate the developing rollers 2 of the MCY developing units 31 to 33 in the direction opposite from the direction indicated by arrows in FIG. 1, that is, in the direction opposite from the direction they rotate during normal developing operations. As a result, any degraded toner that remains in the developing portion 24 can be more reliably moved into the toner box 25. It is preferable that the developing rollers 2 be rotated in the direction opposite from the direction they rotate during normal developing operations by less than a single full rotation. This prevents damaging the seal (not shown) provided for preventing toner leaks.

Although it is desirable that all of the degraded toner drop from the developing portion 24 into the toner box 25, good image quality can be maintained if 15 g or less of degraded toner per every 22 cm length of the developing roller 2 remains in the developing portion 24. This 22 cm length corresponds to the width of an A4 sized sheet. When the amount of degraded toner remaining in the developing portion 24 is suppressed to 15 g or less, then only a low ratio of degraded toner will be mixed in with new toner when the new toner box 25 is attached to the developing portion 24. Good image quality can be maintained when only such a small ratio of degraded toner remains in the developing portion 24. Polymerized toner has extremely high fluidity because the toner particles have a nearly perfect spherical shape. Because polymerized toner is used in the developing portion 24, almost all of the toner smoothly flows back into the old toner box 25 and very little remains in the developing portion 24.

When the MCY developing units 31 to 33 are pivoted in the direction of arrow B into the upright posture shown in broken line of FIG. 1, the urging force of the spring 63 pops the lever 62 out from the MCY developing units 31 to 33 in the direction of arrow D as shown in FIG. 2. As a result, the link mechanisms 61 push the protective members 60 to protrude outward from the MCY developing units 31 to 33.

Next, the user detaches the developing portion 24 from the toner box 25. Because the protective members 60 protrude outward at this time, even if the user carelessly places the developing portion 24, for example, on a table top with the developing rollers 2 facing down, the protective members 60 will reliably protect the developing rollers 2 from being damaged.

Next, the user removes the toner box 25 by lifting the toner box 25 from the support shaft 50. Then, the user attaches a new toner box 25 filled with new toner onto the support shaft 50. The user then attaches the developing portion 24 onto the new toner box 25 and pivots the MCY developing units 31 to 33 back into the position in confrontation with the photosensitive body belt 47. As a result, the link mechanism 61 presses the protective members 60 back into the MCY developing units 31 to 33 so that the color printer 30 is returned to a condition wherein developing is possible.

In this way, when the toner box 25 is to be exchanged, the developing portion 24 is moved to a position vertically above the toner box 25 and further the developing rollers 2 are driven to rotate in a direction opposite from the direction they rotate during normal developing operations. As a result, the degraded toner can be reliably collected into the old toner box 25 and so reliably prevented from mixing with new toner in the new toner box 25 after the toner box 25 is exchanged. Therefore, high image quality that was achieved before the toner box 25 was exchanged can be maintained after the toner box 25 is exchanged.

Because the toner hoppers 21 of the three MCY developing units 31 to 33 are formed integrally together as the toner box 25, three different colors of toner can be replenished simultaneously. Therefore, there will be no variation in image quality between the different color portions of color images.

Because the protective members 60, which are for protecting the developing rollers 2, protrude outward while toner box 25 is being exchanged, contact between the toner-bearing surface of the developing roller 2 and surrounding components can be reliably prevented so the toner-bearing surface can be reliably prevented from being damaged.

Next, modifications of the embodiment will be described. It should be noted that like components between the embodiment and the modifications will be referred to using the same numbering to avoid redundancy of explanation.

The embodiment describes the MCY developing units 31 to 33 as being pivotable with respect to the casing of the color printer 30 to move the developing portion 24 to a position above the toner box 25. However, according to a first modification of the embodiment, one or more protrusions are provided on the casing of the MCY developing units 31 to 33. That is, the color printer 30 can be designed so that the MCY developing units 31 to 33 can be detached from the casing of the color printer 30 by moving the MCY developing units 31 to 33 upward or by moving the MCY developing units 31 to 33 towards the viewer of the sheet on which FIG. 1 is printed. In these cases, the protrusions on the casing insure that when the user places the separated MCY developing units 31 to 33 on the floor, a table top, or other surface, the developing portion 24 will be in a position vertically above the toner box 25. As a result, any degraded toner remaining in the developing portion 24 will flow down into the old toner box 25 and be reliably collected there before the new toner box 25 is attached to the developing portion 24.

Figure 3:
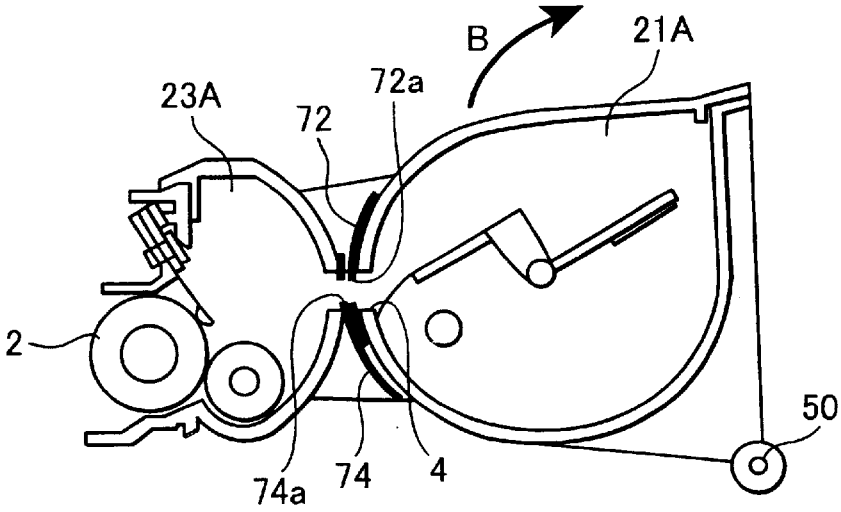
FIG. 3 is a schematic cross-sectional view showing a developing unit according to a second modification of the embodiment.
Figure 4:
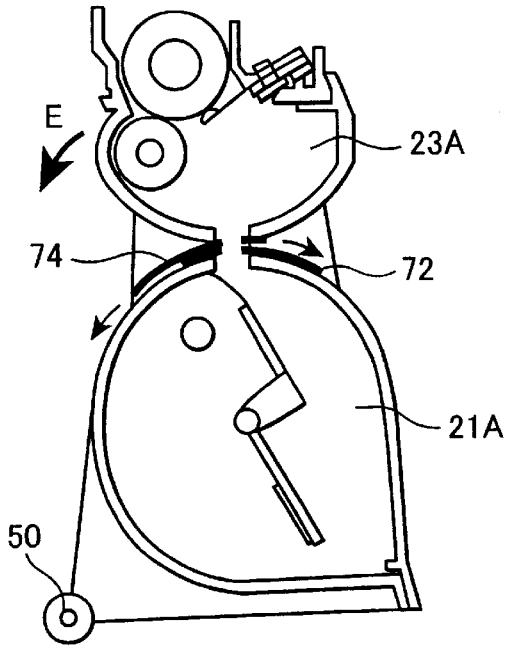
FIG. 4 is a schematic cross-sectional view showing the developing unit of FIG. 3 after being rotated into an upright condition.
Figure 5:
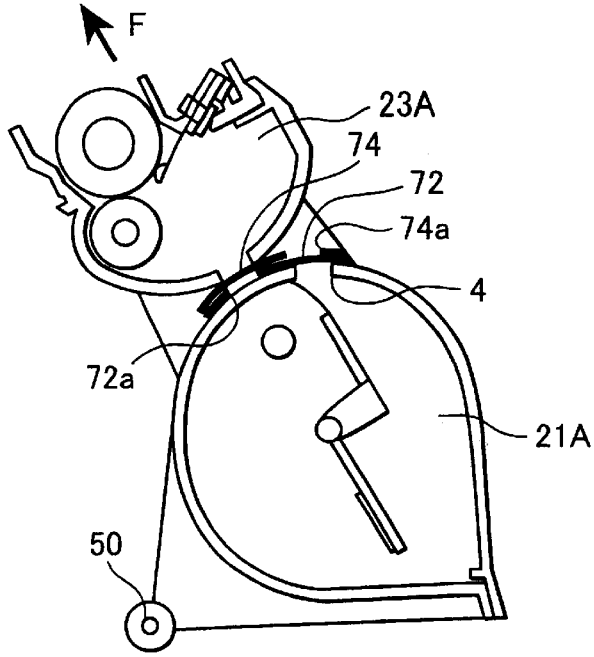
FIG. 5 is a schematic cross-sectional view showing the developing unit of FIG. 3 after a developing chamber thereof is shifted so it can be removed.

According to a second modification of the embodiment, a shutter mechanism is provided for covering the through hole 4 in association with detachment of the developing portion 24 from the toner box 25 during exchange of the toner box so that toner can be reliably prevented from leaking out of the toner box 25. FIGS. 3 to 5 show a toner hopper 21A and a developing chamber 23A according to the second modification. The toner hopper 21A and the developing chamber 23A includes shutters 72, 74, respectively formed with holes 72*a*, 74*a* that are aligned with the through hole 4 of the toner hopper 21A when the toner hopper 21A is properly attached to the developing chamber 23A. When the toner hopper 21A is to be exchanged, first the toner hopper 21A and the developing chamber 23A are pivoted in the direction B about the support shaft 50 into the upright posture shown in FIG. 4. Because the inner surface of the developing chamber 23A has a curved shape centered on the through hole 4 of the developing chamber 23A, toner more easily flows to the through hole 4 and into the through hole 4 of old toner hopper 21A. Then the developing chamber 23A is shifted in the direction E with respect to the toner hopper 21A into the position shown in FIG. 5 in order to disconnect the developing chamber 23A from the toner hopper 21A. At this time, a linking mechanism (not shown) transmits force of the shifting movement to move the shutters 72, 74 in the directions indicated by arrows shown in FIG. 4. As a result, the openings 72*a*, 74*a* of the shutters 72, 74 move out of alignment with the through hole 4. Then the developing chamber 23A is lifted in the direction F and removed from the toner hopper 21A. Toner will not leak from the developing chamber 23A or the toner hopper 21A because the shutter 72 blocks the through hole 4 of the toner hopper 21A and the shutter 74 blocks the through hole 4 of the developing chamber 23A.

According to a third modification, the color printer 30 is designed with a cover (not shown) that opens to the right, that is, as viewed in FIG. 1, so that the MCY developing units 31 to 33 can be moved laterally and removed from the right of the color printer 30 in this way. In the third modification also, it is desirable to provide one or more protrusions to the developing-portion-side of the casing of the MCY developing units 31 to 33 in order to insure that when the user places the separated MCY developing units 31 to 33 on the floor, a table top, or other surface, the developing portion 24 will be in a position vertically above the toner box 25. As a result, any degraded toner remaining in the developing portion 24 will flow down into the old toner box 25 and be reliably collected there before the new toner box 25 is attached to the developing portion 24.

Figure 6:
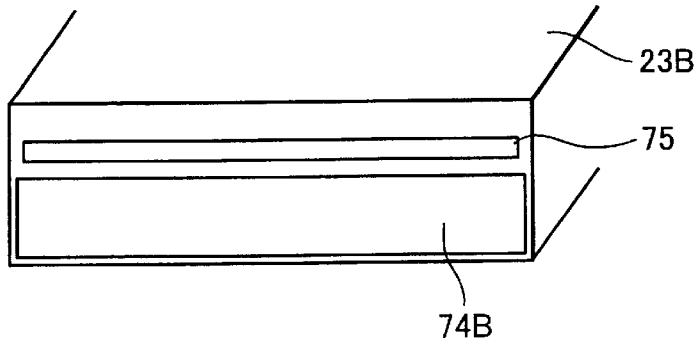
FIG. 6 is a partial perspective view showing a developing chamber according to third modification of the embodiment.
Figure 7:
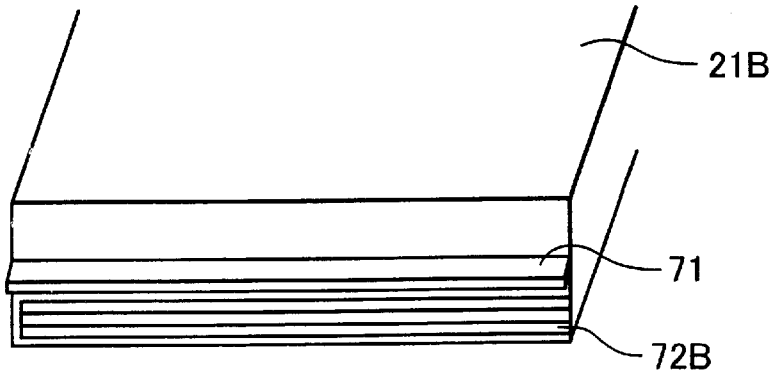
FIG. 7 is a partial perspective view showing a toner box according to the third modification.
Figure 8:
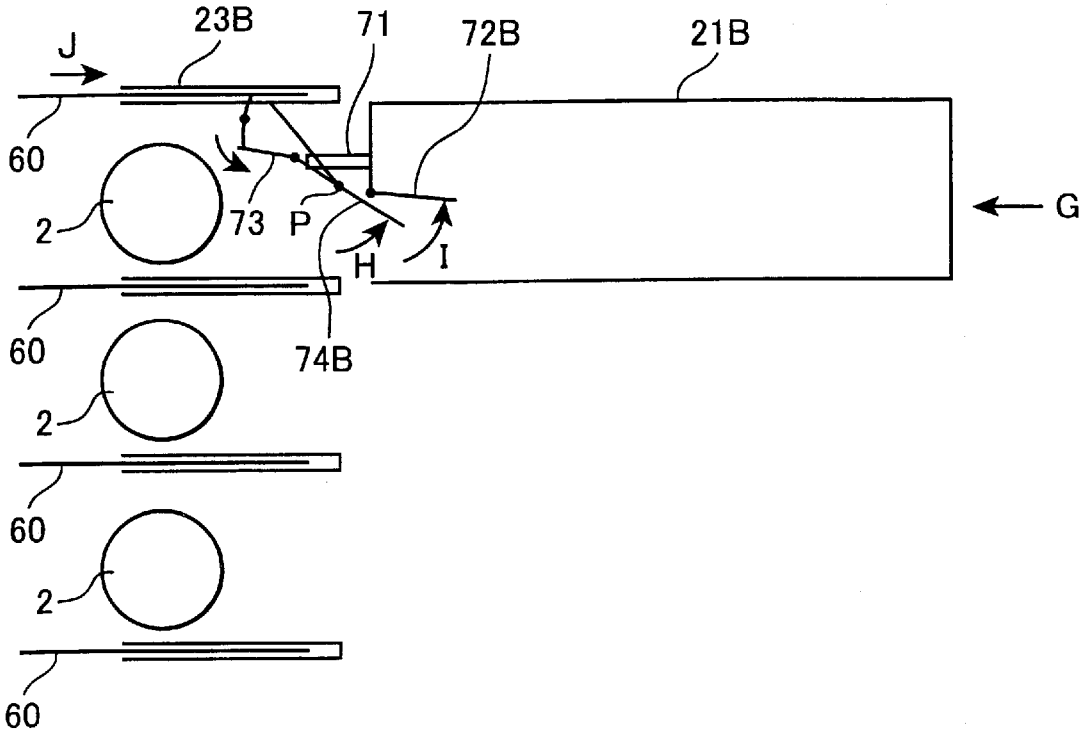
FIG. 8 is a schematic cross-sectional view showing operation of a shutter mechanism of the third modification when the toner box of FIG. 7 is inserted into the developing chamber of FIG. 6.

It is also desirable that the third modification be provided with a shutter mechanism. FIGS. 6 to 8 show a toner hopper 21B and a developing chamber 23B according to the third modification provided with a shutter mechanism. As shown in FIG. 6, the developing chamber 23B is provided with a shutter 74B and a slit 75. FIG. 6 is a view of the side of the developing portion 24 that connects with the toner box 25. As shown in FIG. 7, the toner hopper 21B is provided with a shutter 72B and a protrusion 71. The protrusion 71 is inserted into the slit 75 when the toner hopper 21B is connected to the developing chamber 23B. As shown in FIG. 8, the developing portion 23B is also provided with a linking mechanism 73.

When the toner hopper 21B is mounted onto the developing chamber 23B by being pushed laterally in the direction G, then the protrusion 71 pushes the shutter 74B to pivot around axis P. As a result, the lower end of the shutter 74B rises upward in the direction H and presses a shutter 72B open in the direction I. At this time the linking mechanism 73 is driven to retract in the protective member 60.

On the other hand, when the toner hopper 21B is removed from the developing chamber 23B by being pulled laterally in the direction opposite of direction G, then the protrusion 71 pulls away from the shutter 74B so that the shutter 74B moves in the direction opposite from direction H away from the shutter 72B. The shutter 72B closes as a result. At this time the linking mechanism 73 is driven to protrude the protective member 60 out.

With this configuration, the shutter member 72B of the toner hopper 21B blocks the through-hole opening in the toner hopper 21B when the toner hopper 21B is taken off the developing chamber 23B and opens up the through-hole opening when the toner hopper 21B is attached to the developing chamber 23B. The shutter member 72B reliably prevents toner from leaking out of the toner hopper 21B before and after the toner hopper 21B is exchanged. Because the shutter 74B opens the through-hole opening in the developing chamber 23B in association with mounting the toner hopper 21B onto the developing chamber 23B, the developing chamber 23B can be brought into a usable condition without fear of toner stains. Also, the protective members 60 move when a toner box 25 is exchanged, so that the developing rollers 2 will not be damaged.

According to a fourth modification, a sliding configuration can be provided to facilitate removal of the MCY developing units 31 to 33 when the color printer 30 is designed so that the MCY developing units 31 to 33 can be detached by moving the MCY developing units 31 to 33 towards the viewer of the sheet on which FIG. 1 is printed or to the right side of FIG. 1 through an open cover (not shown).

Figure 9:
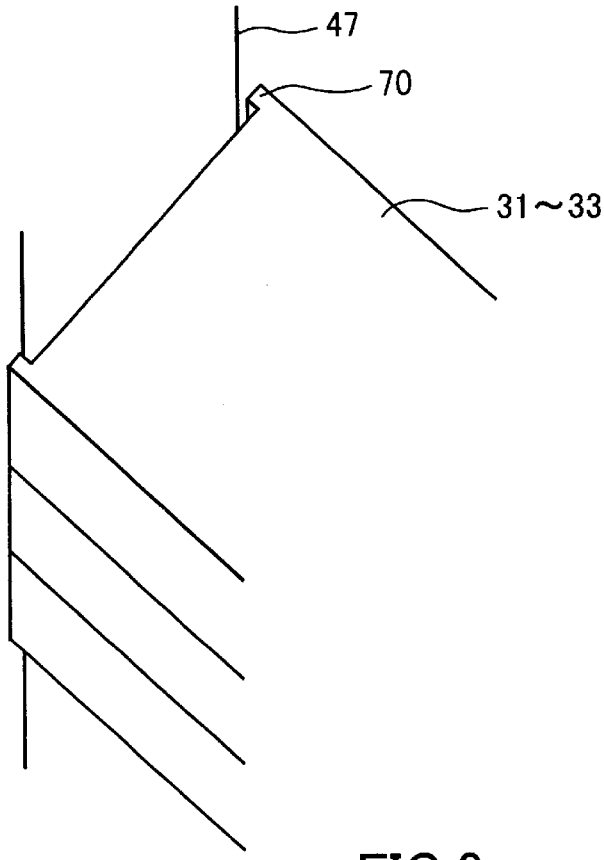
FIG. 9 is a perspective view showing integral developing units according to a fifth modification of the embodiment.

According to a fifth modification shown in FIG. 9, the case of the MCY developing units 31 to 33 is provided with integral protrusions 70 that protrude further out from the case than the outermost protruding portion of the developing rollers 2. The protrusions 70 are formed on the case at positions that are on either side of the photosensitive body belt 47 in the widthwise direction of the photosensitive body belt 47 when the MCY developing units 31 to 33 are brought into confrontation with the photosensitive body belt 47. With this configuration, the developing rollers 2 can be reliably protected without the need to provide the link mechanism 61 shown in FIG. 2.

Figure 10:
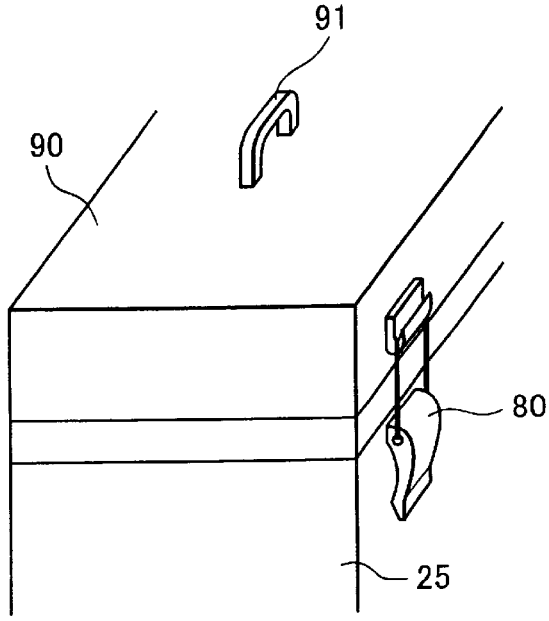
FIG. 10 is a partial perspective view showing a toner box according to a sixth modification of the embodiment.

Next, a sixth modification will be described with reference to FIGS. 10 to 12. As shown in FIG. 10, the toner box 25 is provided with a lid member 90 and a lock arm 80. The lid member 90 seals the toner box 25. The lid member 90 is provided with a handle 91. A resilient member 92 for increasing the seal of the toner box 25 is provided to one or more of the toner box 25, the lid member 90, and the developing portion 24 where the toner box 25 connects to the lid member 90 or the toner box 25.

Figure 11:
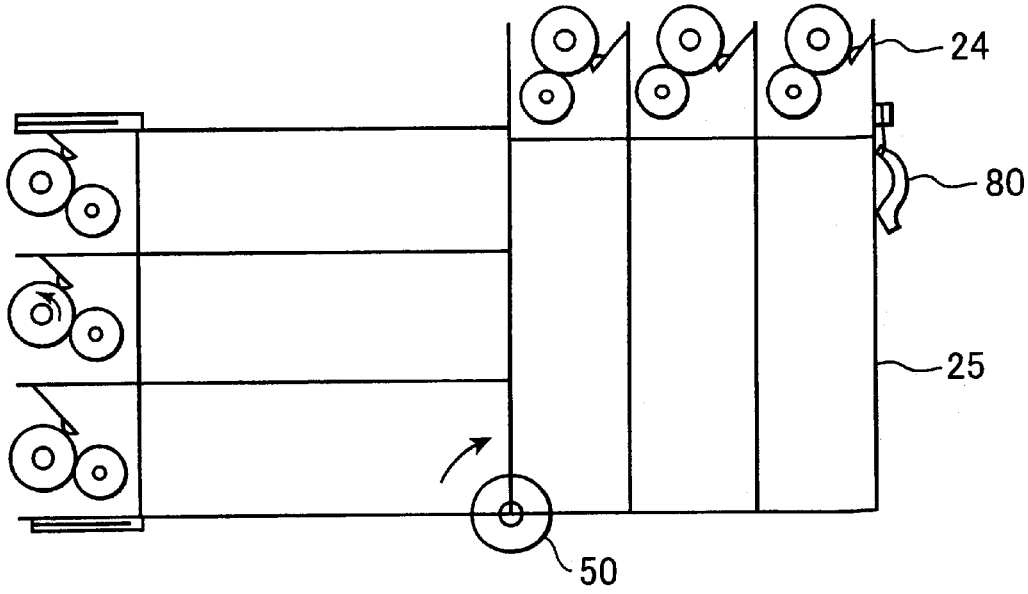
FIG. 11 is a schematic cross-sectional view showing integral developing units including the toner box of FIG. 10.
Figure 12:
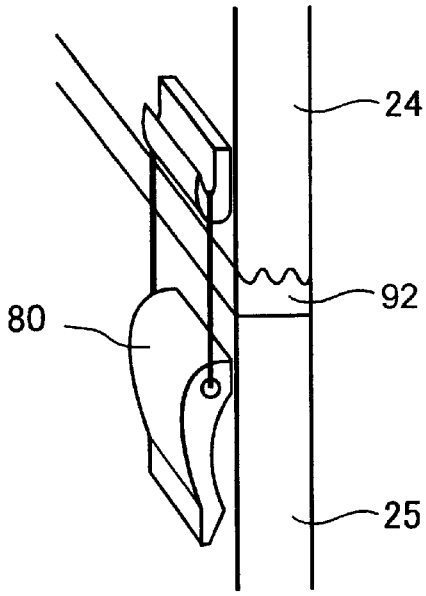
FIG. 12 is a partial perspective view showing a locking mechanism of the toner box of FIG. 10.

When an old toner box 25 is exchanged for a new one, first the old toner box 25 is pivoted around the support shaft 50 as shown in FIG. 11. Then, the lock arm 80 of the old toner box 25 is released and the old toner box 25 is removed from the developing portion 24. Next, the lock arm 80 of the new toner box 25 is released and the lid member 90 of the new toner box 25 is removed. Then, the new toner box 25 is mounted on the developing portion 24 and locked in place using the lock arm 80. Then, the lid member 90 of the new toner box 25 is mounted on the old toner box 25 and attached in place using the lock arm 80 of the old toner box 25.

With this configuration, toner leaks and toner stains can be prevented from occurring while the toner box 25 is stored, transported, or exchanged. The handle 91 facilitates handling of the toner box 25 during storage, transport, and exchange of the toner box 25, so that toner leaks can be reliably prevented after the toner box 25 is exchanged and stains can be reliably prevented during transport of the toner box 25. It should be noted that the lock arm 80 could be provided to the lid member 90 instead of to the toner box 25.

Figure 13:
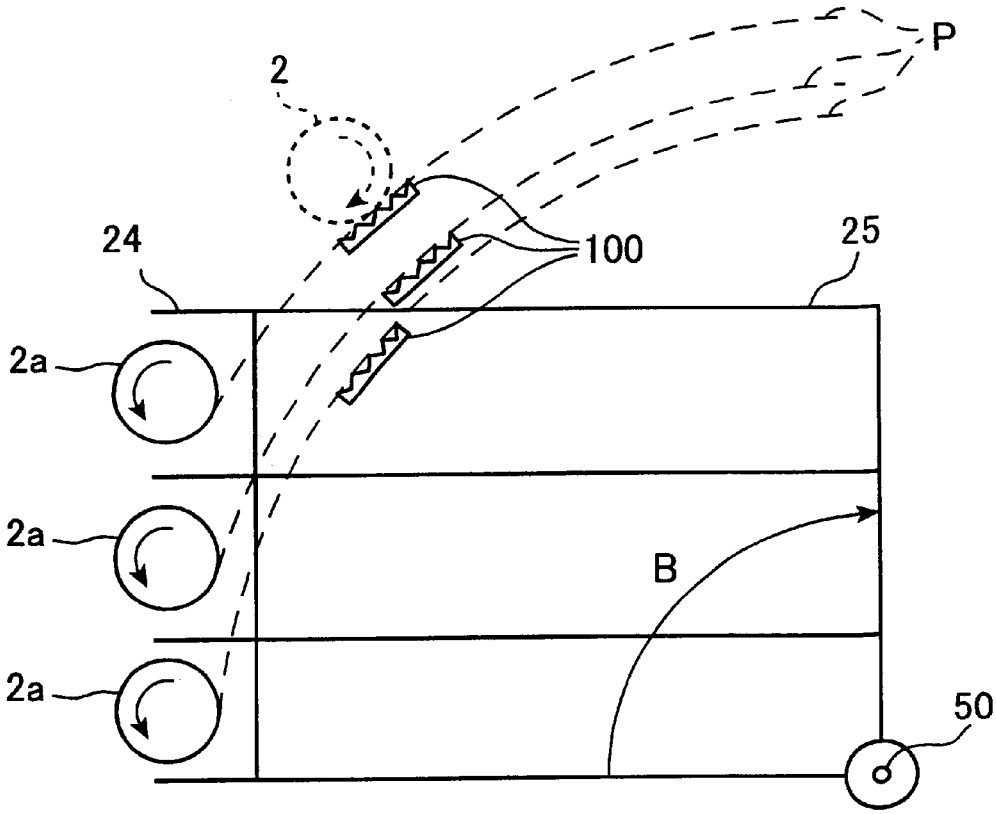
FIG. 13 is a schematic cross-sectional view showing reverse direction gears according to a seventh modification of the embodiment for rotating the developing rollers in a direction opposite from the direction they rotate during a normal developing operations.

Next, a seventh modification will be described with reference to FIG. 13. As shown in FIG. 13, gears 2*a* of the developing rollers 2 follow a path P when the toner box 25 is pivoted in the direction B around the support shaft 50. Reverse direction gears 100 are provided along the path P at positions so as to meshingly engage with corresponding ones of the gears 2*a* when the toner box 25 is pivoted 90 degrees around the support shaft 50. As a result, when the toner box 25 is pivoted into its upright posture, the gears 2*a* engage with the reverse direction gears 100 so that the developing rollers 2 rotate in the opposite direction indicated in FIG. 13 by broken-line arrows, which is opposite from the direction the developing rollers 2 rotate during normal developing operations indicated by solid-line arrows in FIG. 13. With this configuration, any degraded toner that remains in the developing portion 24 can be reliably moved into the toner box 25 without the control unit (not shown) of the color printer 30 having to control to rotate the developing rollers 2 as in the embodiment. In this case also, it is preferable that the developing rollers 2 be rotated in the direction opposite from the direction they rotate during normal developing operations by less than a single full rotation. This prevents damaging the seal (not shown) provided for preventing toner leaks.

While the invention has been described in detail with reference to a specific embodiment and modifications thereof, it would be apparent to those skilled in the art that various changes and modifications may be made therein without departing from the spirit of the invention, the scope of which is defined by the attached claims.

For example, the embodiments describe the present invention applied to a color printer. However, the present invention is not limited to use in color printers, but could be used with monochrome image forming devices as well.

Further, the embodiments describe the present invention applied to a developing device of a printer that uses a photosensitive belt. However, the present invention is not limited to this, and can be applied to a developing device of a printer that uses a photosensitive drum. The present invention could also be applied to printers that do not use photosensitive drums, such as printers that use a multistylus electrode or that directly control flow of toner.

Further, the embodiment describe the present invention applied to a printer that uses non-magnetic single-component toner made using polymerization. However, the present invention can be applied to an image forming device that uses pulverized toner as the developing agent.

The embodiments describe that degraded toner is moved back into the old toner box 25 by gravity or by the reverse rotation of the developing roller 2. However, degraded toner can be moved back into the old toner box 25 by reverse rotation of the supply roller 3 or by a vibrator such as a piezoelectric element.

The present invention reliably prevents generation of fogging, reduction in image quality, changes in image quality, and other problems related to use of degraded toner from occurring even when an exchangeable toner box 25 is used. The present invention also reliably prevents the developing roller 2 from being damaged when the exchangeable toner box 25 is exchanged.

What is claimed is:

1. A developing device comprising:

an exchangeable developing-agent holding portion and a developing portion freely detachably attached to each other, the developing-agent holding portion holding developing agent and having a through hole for supplying the developing agent, the developing portion being in fluid communication with the through hole of the developing-agent holding portion;

seal means for sealingly covering the through hole of the developing-agent holding portion; and a developing-agent moving means that functions to move residual developing agent from the developing portion into the developing-agent holding portion before the developing-agent holding portion is at least one of exchanged for a new developing-agent holding portion and removed from the developing portion.

2. A developing device as claimed in claim 1, wherein the developing-agent moving means includes a position controller that guides the developing portion into a position vertically above the developing-agent holding portion before the developing-agent holding portion is exchanged for a new developing-agent holding portion.

3. A developing device as claimed in claim 1, wherein the developing-agent holding portion includes three integrally connected developing-agent holding vessels for separately holding three colors of developing agent, the developing portion includes three integrally connected developing units for developing images using the three integrally connected developing-agent holding vessels and the three integrally connected developing units being freely detachably attached to each other.

4. A developing device as claimed in claim 1, wherein the seal means is a lid member that covers the through hole, the lid member including a handle for facilitating transport of the developing-agent holding portion after exchanging the developing-agent holding portion.

5. A developing device as claimed in claim 1, wherein the seal means is a shutter means for covering the through hole in association with detachment of the developing-agent holding portion from the developing portion during exchange of the developing-agent holding portion.

6. A developing device as claimed in claim 5, wherein the new developing-agent holding portion includes a shutter means that opens the through hole in the new developing-agent holding portion in association with mounting of the new developing-agent holding portion on the developing portion during exchange of the developing-agent holding portion.

7. A developing device as claimed in claim 1, wherein the developing portion includes a developing-agent bearing body having a surface that bears developing agent supplied from the developing-agent holding portion through the through hole.

8. A developing device as claimed in claim 7, further comprising a protection means for preventing contact between the surface of the developing-agent bearing body and surrounding items during exchange of the developing-agent holding portion.

9. A developing device as claimed in claim 7, wherein the developing-agent bearing body includes a urethane coat layer at its outer peripheral surface.

10. A developing device as claimed in claim 7 wherein the developing-agent moving means is adapted to move all but 15 gms or less of residual developing agent per every 22 cm length of the surface of the developing-agent bearing body from the developing portion into the developing-agent holding portion.

11. An image forming device, comprising:

a housing a latent image bearing unit bearing a latent image;

a developing unit freely detachably attached to the housing and including:

an exchangeable developing-agent holding portion holding developing agent and having a through hole for supplying the developing agent; and a developing portion in fluid communication with the through hole of the developing-agent holding portion, the developing portion including a developing-agent bearing body having a surface that bears developing agent supplied through the through hole of the developing-agent portion, the developing-agent bearing body transporting developing agent borne on the surface to the latent image borne by the latent image bearing unit, the developing-agent holding portion being freely detachably attached to the developing portion; and a developing-agent moving means that function to move residual developing agent from the developing portion into the developing-agent holding portion before the developing-agent holding portion is exchanged for a new developing-agent holding portion, wherein the developing-agent holding portion includes three integrally connected developing-agent holding vessels for separately holding three colors of developing agent, the developing portion includes three integrally connected developing units for developing images using the three colors of developing agent held in the three developing-agent holding vessels, the three integrally connected developing-agent holding vessels and the three integrally connected developing units being freely detachably attached to each other.

12. An image forming device as claimed in claim 11, wherein the developing-agent holding portion is freely detachably attached to the housing.

13. An image forming device as claimed in claim 11, wherein the developing-agent moving means includes a position controller that controls the developing portion into a position vertically above the developing-agent holding portion before the developing-agent holding portion is exchanged for a new developing-agent holding portion.

14. An image forming device as claimed in claim 13, wherein the developing-agent bearing body of the developing portion is a roller that rotates in a predetermined direction to transport the developing agent during image developing operations, the developing-agent moving means controlling the developing-agent bearing body to rotate in a direction opposite from the predetermined direction while the developing portion is in the position vertically above the developing-agent holding portion.

15. An image forming device as claimed in claim 13, wherein the position controller supports the developing unit pivotable with respect to the housing.

16. An image forming device as claimed in claim 11, wherein the developing-agent bearing body of the developing portion is a roller that rotates in a predetermined direction to transport the developing agent during image developing operation, the developing-agent moving means controlling the developing-agent bearing body to rotate in a direction opposite from the predetermined direction during exchange of the developing-agent holding portion.

17. An image forming device, comprising:

a housing:

a latent image bearing unit bearing a latent image;

a developing unit freely detachably attached to the housing and including:

an exchangeable developing-agent holding portion holding developing agent and having a through hole for supplying the developing agent; and a developing portion in fluid communication with the through hole of the developing-agent holding portion, the developing portion including a developing-agent bearing body having a surface that bears developing agent supplied through the through hole of the developing-agent holding portion, the developing-agent bearing body transporting developing agent borne on the surface to the latent image borne by the latent image bearing unit, the developing-agent holding portion being freely detachably attached to the developing portion; and a developing-agent moving means that functions to move residual developing agent from the developing portion into the developing-agent holding portion before the developing-agent holding portion is exchanged for a new developing-agent holding portion, wherein the developing-agent moving means is adapted to move all but 15 gms or less of residual developing agent per every 22 cm length of the surface of the developing-agent bearing body from the developing portion into the developing-agent holding portion.

* * * * *